US005953841A

United States Patent [19]

Sawyer

[11] Patent Number: 5,953,841

[45] Date of Patent: Sep. 21, 1999

[54] WIND DRIVEN ROTATABLE DISPLAY

[76] Inventor: Jeffrey C. Sawyer, 4 Seashore Dr., Ormond Beach, Fla. 32176

[21] Appl. No.: 08/777,286

[22] Filed: Dec. 27, 1996

[51] Int. Cl.[6] ..... G09F 11/02

[52] U.S. Cl. ..... 40/479; 40/124.191; 40/484; 40/493; 40/602; 40/606

[58] Field of Search ..... 40/484, 493, 606, 40/607, 602, 612, 479, 124.191

[56] References Cited

U.S. PATENT DOCUMENTS

| | | | |
|---|---|---|---|
| 911,991 | 2/1909 | Igelstroem . | |
| 949,538 | 2/1910 | Igelstroem . | |
| 1,535,844 | 4/1925 | McLemore . | |
| 1,635,915 | 7/1927 | White . | |
| 1,838,230 | 12/1931 | Marsh . | |
| 1,954,721 | 4/1934 | Whitlow | 40/479 |
| 2,069,110 | 1/1937 | Naus | 40/479 |
| 2,499,594 | 3/1950 | Kulay . | |
| 2,810,223 | 10/1957 | Fraesdorf, Jr. | 40/479 |
| 3,108,696 | 10/1963 | Winner | 40/124.191 X |
| 3,172,220 | 3/1965 | Christensen | 40/493 X |
| 3,318,279 | 5/1967 | Padilla | 40/607 X |
| 3,579,885 | 5/1971 | Iverson | 40/607 |
| 3,973,341 | 8/1976 | Kent, Jr. | 40/124.191 |
| 4,202,121 | 5/1980 | Maris et al. | 40/606 X |
| 4,353,179 | 10/1982 | Jennings | 40/607 X |
| 4,392,316 | 7/1983 | Thomas . | |
| 4,658,527 | 4/1987 | Pingel | 40/606 |
| 4,991,335 | 2/1991 | Krautsack . | |
| 5,249,771 | 10/1993 | Wear . | |
| 5,566,483 | 10/1996 | Ogren | 40/606 |
| 5,613,799 | 3/1997 | Guide | 40/612 X |

FOREIGN PATENT DOCUMENTS

| | | | |
|---|---|---|---|
| 4034037 | 9/1991 | Germany | 40/606 |
| 701897 | 1/1954 | United Kingdom | 40/493 |

*Primary Examiner*—Donald P. Walsh
*Assistant Examiner*—Emmanuel M. Marcelo
*Attorney, Agent, or Firm*—Andrus, Sceales, Starke & Sawall

[57] ABSTRACT

A wind driven sign or advertising display comprising a plurality of generally flat panels each having an inner side edge that is received within a radial recess in a central support member. Each panel is composed of a corrugated plastic material including a pair of outer faces and a plurality of parallel ribs that connect the faces together. Graphics can be applied to one or more of the faces of the panels. The central support member is mounted for rotation with respect to a fixed outer object, so that the sign can be rotated about the mounting by the wind or air currents.

7 Claims, 2 Drawing Sheets

WIND DRIVEN ROTATABLE DISPLAY

BACKGROUND OF THE INVENTION

Various types of promotional or advertising devices are used by realtors, automobile dealers, or other commercial establishments to advertise or promote products or services. While many of the advertising devices are in the form of fixed signs, other advertising devices are adapted to be suspended from a fixed support, so that they can be rotated by the wind or air currents. For example, U.S. Pat. No. 911,991 shows a sign having a pyramidal configuration which is adapted to be suspended from a chandelier or other fixture, and the sides of the pyramidal sign are intended to include graphics or other written material. Similarly, U.S. Pat. Nos. 949,539 and 1,838,230 disclose signs or advertising displays that are formed from folded sheet material and are suspended from a fixed object and are adapted to be rotated by wind currents.

U.S. Pat. No. 5,249,771 also discloses a hanging sign or advertising display which is produced by folding a blank of sheet material. Similarly, U.S. Pat. Nos. 4,392,316 and 4,991,335 also describe generally triangular advertising displays or signs which are formed from folded sheet material and are adapted to be suspended from a fixed object.

U.S. Pat. Nos. 1,535,844 and 1,635,915 show warning devices formed of interconnected panels bearing graphics or warning signs that are adapted to be suspended from the end of a load or cargo.

SUMMARY OF THE INVENTION

The invention is directed to an improved wind driven rotatable advertising display or sign. In accordance with the invention, the advertising display comprises a plurality of generally flat panels each having a side edge which is received within a radial recess in a central support member. With this construction the panels radiate from the central support manner in spaced relation.

Each panel is formed of corrugated plastic material, including a pair of outer faces which are connected together by a plurality of parallel ribs.

A rotatable support mechanism is connected to one end of the central support member which enables the display to be rotated about the axis of the support member by the wind or air currents. Graphics or advertising material can be applied to the faces of the panels and as the display is rotated by the wind, the graphics will be visible to the consumer.

It is also contemplated that the outer end portion of each of the panels can be bent at an angle to the body of the panel to aid in rotation of the sign. To maintain the panel in the bent condition, an elongated deformable member, such as a wire, is embedded in the panel and extends across the joint between the bent end portion and the body of the panel. When the end portion is bent to the desired angularity, the wire will be correspondingly bent and will maintain the bent end of the panel in the bent condition.

In one form of the invention, the display or sign is adapted to be mounted on a fixed object, such as an existing sign. To mount the display on the existing sign, an elongated member or wire extends through a central longitudinal passage in the central support member and the support member, as well as the panels carried by the support member, are thus journaled about the wire. The lower end of the wire is provided with an attaching mechanism which enables the wire to be connected to an existing sign, or other fixed object. In a preferred form of the invention, the attaching mechanism can take the form of a spring clamp which fits over the top edge of an existing sign. In another form of the invention, the attaching mechanism may take the form of a stake which is driven into the ground, or other supporting structure.

In a second form of the invention, the advertising display is adapted to be suspended from an upper fixed support. In this regard an elongated member or wire is passed through the central opening of the support member and the upper end of the wire which projects beyond the upper edges of the panels is connected through a swivel to a hook that can be attached to an outside object. In practice, the hook may be attached to the underside of the open hood of an automobile at an automobile dealership, or the hook may be connected to the ceiling near the outlet of a ventilating duct in a department store or other commercial establishment. The wind or air currents will thus rotate the advertising display about the swivel connection.

It is also contemplated that an insert sheet, preferably composed of plastic material, can be connected between the outer vertical edges of adjacent panels of the advertising display. The outer surface of the insert can bear graphics having a different message than that on the panels, so that the advertising or promotional message can be readily varied by connecting the inserts to the panels.

The advertising display or sign of the invention can either be mounted on a fixed support or suspended from above. In either case, the panels will be rotated by the wind or air currents to provide an eye-catching promotional display.

The corrugated plastic panels are rigid and have a smooth outer surface which provides a sharp resolution for the printing or graphics. Further, the plastic panels are waterproof and will not warp or decompose under atmospheric conditions, such as snow or rain. As a further advantage, the panels are self-supporting and do not require any additional hardware or fasteners and are merely press-fitted into the recesses of the central support member.

The display of the invention can be used to promote sales, or new products, or services. In addition, the displays can be used as warning signs to border a driveway, culvert, or an area under construction.

Other objects and advantages will appear in the course of the following description.

DESCRIPTION OF THE DRAWINGS

The drawings illustrate the best mode presently contemplated of carrying out the invention.

In the drawings.

DETAILED DESCRIPTION OF THE INVENTION

Figure 1:
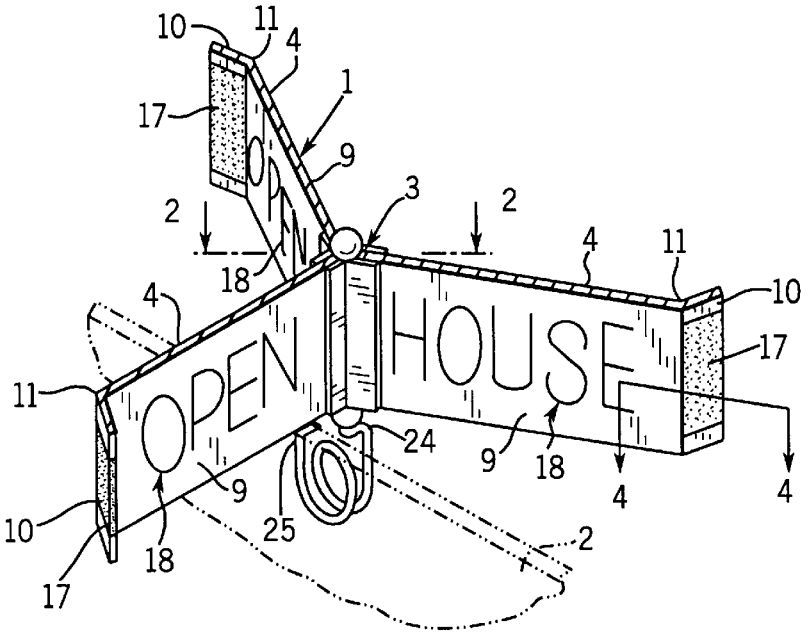
FIG. 1 is a perspective view of the advertising display of the invention, as mounted on a fixed object such as an existing sign.
Figure 2:
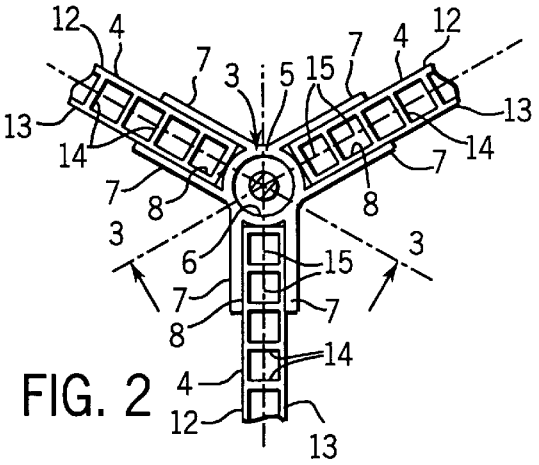
FIG. 2 is a fragmentary horizontal section taken along line 2—2 in FIG. 1 showing the connection of the panels to the central support; 2 showing the attachment of the advertising display to the fixed support.

FIG. 1 shows a wind driven rotatable advertising display or sign 1, which is adapted to be mounted on a fixed object, such as an existing sign 2.

The advertising display 1 includes a central support 3, preferably formed of extruded plastic, and a plurality of generally flat panels 4 extend outwardly from central support 3. As shown in the drawings, three panels 4 are utilized, but it is contemplated that any number of panels may be employed.

Central support 3 includes an elongated central section 5 having a longitudinal passage 6 that extends therethrough. A plurality of arms 7 extend generally radially from central section 6 and each pair of arms defines a radial recess 8 which receives the inner edge of a panel 4. Support 3 is preferably extruded from a thermoplastic material, such as polyvinylchloride or polyethylene, with the width of recesses 8 being slightly less than the thickness of the panels 4 and the inner edges of the panels are press-fitted in recesses 8.

Each panel 4 includes a body portion 9 and an outer end portion 10 which is located at an acute angle with respect to body portion 9. A junction or bend 11 connects the end portion 10 of body portion 9.

Each panel 4 is composed of a pair of outer faces 12 and 13 which are connected together by a plurality of generally parallel ribs 14, thus providing a corrugated type of structure. The spaces between ribs 14 define passages 15 and the passages 15 are preferably parallel to the bend or junction 11.

Figure 4:
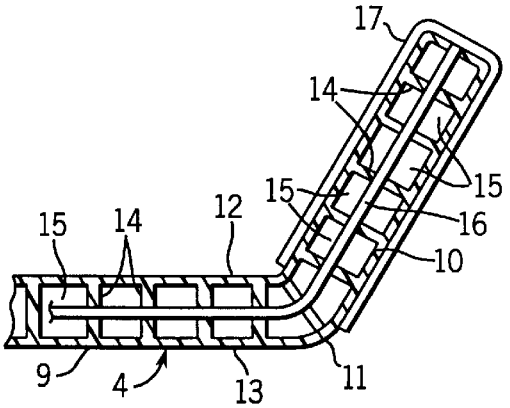
FIG. 4 is a fragmentary horizontal section taken along line 4—4 in FIG. 1 showing the outer end portion of a panel.

To maintain the bent end portion 10 in the bent condition, an elongated deformable member, such as a wire 16, is embedded in each panel and extends across the bend 11, as best illustrated in FIG. 4. With the panel in a flat condition, the wire 16 is driven into the outer side edge of the panel and the panel is then bent along the line 11 and the deformable wire 16 will maintain the outer portion 10 in the angular or bent condition.

If desired, a strip of reflective tape 17 can be applied over the bent end portion 10 as best illustrated in FIG. 4. The reflective tape will reflect automotive headlights, or other lighting, and thus make the sign more noticeable in darkened conditions.

Suitable advertising material or graphics 18 can be applied to one or both faces 12 and 13 of the display, as shown in FIG. 1.

Figure 3:
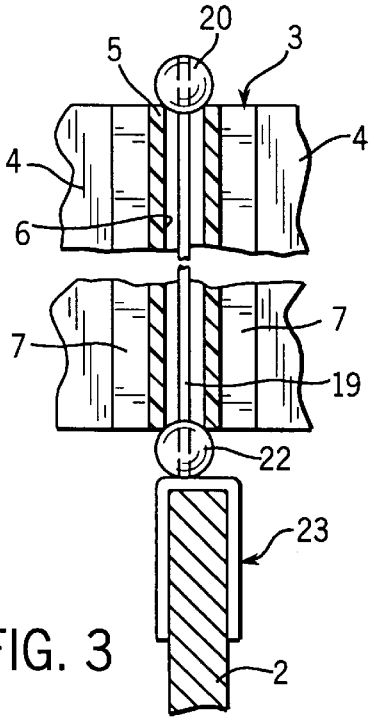
FIG. 3 is a fragmentary vertical section taken along line 3—3 of FIG. 2.

To mount the sign for rotation, an elongated member or wire 19 is inserted in the longitudinal passage 6 of central support 3, as best seen in FIG. 3. The upper end of wire 19 is connected within a generally spherical plastic bead 20, while the lower portion of the wire passes through a second generally spherical plastic bead 22 which is located beneath central support 3. Panels 4, as well as central support 3 are adapted to rotate about wire 19 and the beads 20 and 22 aid in journaling the central support for rotation.

The lower portion of wire 19 below bead 22 is shaped to provide a clamp 23 which can engage the upper edge of existing sign 2, or other object. The clamping portion 23 is provided with a shoulder 24 and the bent end 25 of the wire also defines a second shoulder. The upper edge of the sign 2 is adapted to engage shoulders 24 and 25 with the faces of sign 2 being clamped between the parallel loops of clamp 23. With this construction, the display 1 is mounted for rotation on the existing sign 2 and will rotate under the influence of the wind or air currents, thus providing an eye-catching display to the consumer.

While the drawings illustrate the advertising display 1 being attached to an existing sign 2, it is contemplated that the display can be mounted on any type of fixed support. In one form of the invention, the display can be used as a driveway or culvert marker, or as a warning signal for construction areas, and in this case the lower end of wire 19 can be attached to a stake which is driven into the ground or terrain.

Figure 5:
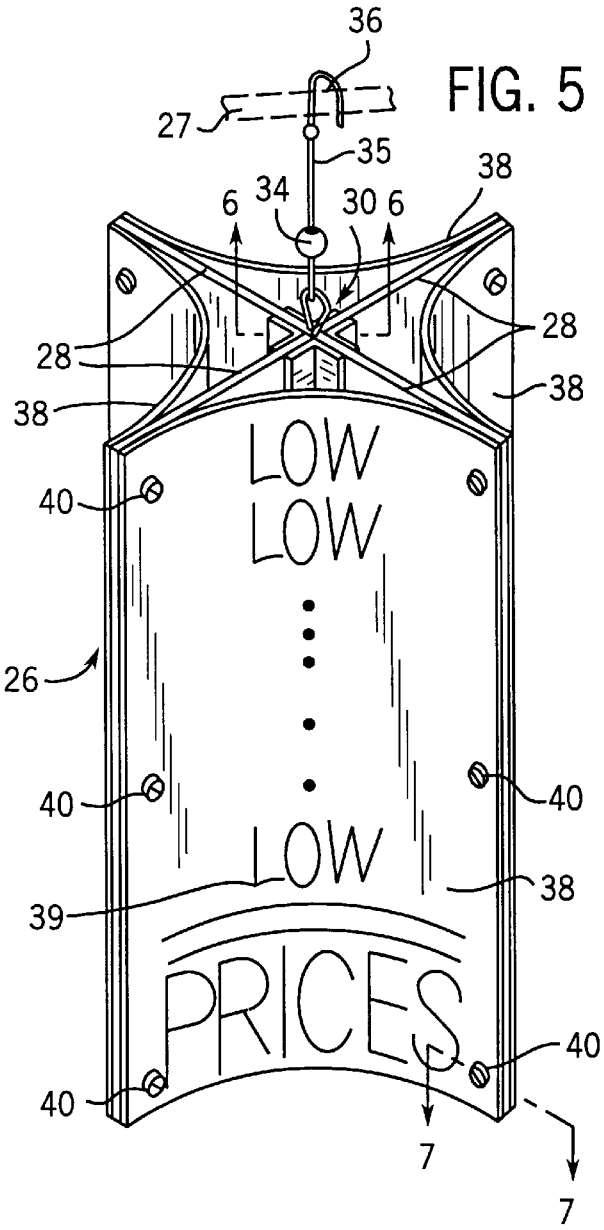
FIG. 5 is a perspective view of a modified form of the invention which is intended to be suspended from a fixed object.
Figure 6:
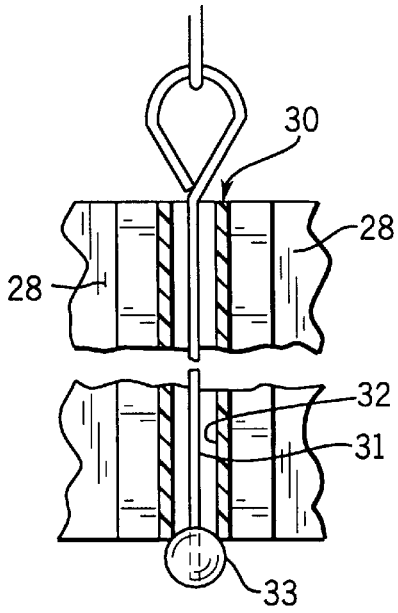
FIG. 6 is a fragmentary longitudinal section taken along line 6—6 in FIG. 5 showing the suspended mechanism for the advertising display.
Figure 7:
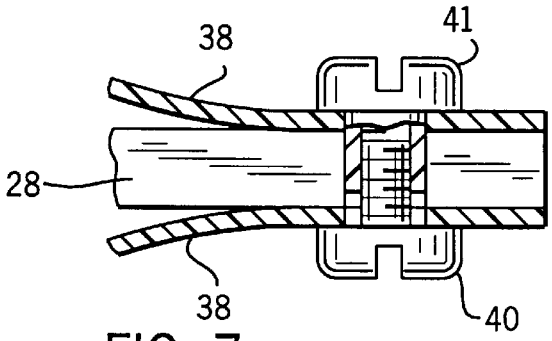
FIG. 7 is a fragmentary horizontal section taken along line 7—7 in FIG. 5 showing the attachment of an insert to one of the panels.

FIGS. 5–7 illustrate a modified form of the invention, in which the wind-driven advertising display or sign 26 is suspended for rotation from an upper fixed object 27.

Sign 26 includes a plurality of panels 28, which are similar in construction to panels 4, and the inner edge of each panel 28 is press fitted within a radial recess in a central support 30, which corresponds to support 3 of the first embodiment. While FIG. 5 shows four panels 28 attached to support 30, it is contemplated that the number of panels 28 can vary.

Panels 28 are formed of corrugated plastic material, and have the same cellular construction as previously described. However, the passages between adjacent ribs of the panels 28 are preferably disposed in a horizontal attitude.

To mount the display 26 for rotation, an elongated element or wire 31 extends through longitudinal passage 32 in central support 30. The lower end of wire 31 is connected to a spherical plastic bead 33, while the upper looped end of wire 32, which is located above the upper end of support 30, is connected to a swivel 34. Swivel 34, in turn, is connected to the lower end of an elastic cord 35, and the upper end of the cord carries a hook 36 which can be attached to an outside fixed object 27. In one form of use, hook 36 can be attached to the underside of an open automobile hood at an automobile dealership, or alternately, attached to any elevated support in a location where the panels can be rotated by the wind. In another form of use, the display can be mounted indoors in a commercial establishment, preferably in the path of the air conditioning or ventilating system, so that the device will be rotated by air currents.

As in the case of the first embodiment, graphics in the form of advertising material or promotional material can be applied to the faces of panels 28.

As best illustrated in FIGS. 5 and 7, flexible auxiliary insert sheets 38, preferably formed of a thermoplastic material, can be attached to the outer side edges of adjacent panels 28. Inserts 38 have a height generally equal to the height of the panels 28, and preferably have a width slightly greater than the distance between side edges of adjacent panels, so that the inserts will bow inwardly, as shown in the drawings when attached to the panels. The outer surfaces of inserts 38 can bear graphics 39 which have a different message than the graphics on the panels 28. Thus, by applying the inserts 38 to the display, a different message can be presented to the consumer.

Inserts 38 are attached to the panels through a series of fasteners that can take the form of screws 40 which extend through suitable aligned holes in the panel, as well as insert 38 and are threaded into buttons 41, as shown in FIG. 7. The screw and button arrangement enables the inserts to be readily attached and removed from panels 28.

The corrugated plastic panels are relatively rigid and will not bend under wind pressure, and yet have a smooth outer surface which provides sharp resolution for the graphics. Due to the stiffness of the panels, no additional hardware is required other than the central support having recesses in which the side edges of the panels are press fitted.

The advertising display can either be mounted on a fixed object, such as an existing sign, or can be suspended from above. Due to the rotation of the panels, an eye-catching display is provided.

It is also contemplated that the lower end of the central support member can be attached to a fixed base, which in turn, can be mounted on a generally flat surface through use of a magnet or an adhesive. With this arrangement, the sign or display can be affixed to the roof or hood of an automobile at a new or used car dealership or can be affixed to the top of a gasoline pump at a service station. As a further application of use, the central support member can be attached through a rigid arm or brace to one or more suction cups, and the suction cups can be applied to a flat vertical surface, such as a glass window.

I claim:

1. In combination, a fixed support having an edge portion, a display mounted to said fixed support and including a tubular member, an elongated wire-form element disposed within said tubular member with the ends of said element projecting outwardly of said tubular member, a first anti-friction member mounted on said element and disposed at a first end of said tubular member and a second anti-frictional member mounted on said element and disposed at a second end of said tubular member, said frictional members acting to support said tubular member for rotation on said element, an end of said element projecting beyond said second frictional member and having a bent section bent at an angle to the axis of said element, and connecting means for connecting said bent section to the edge portion of said fixed support, a plurality of panels each having a side edge, means for attaching the side edge of each panel to said tubular member.

2. The combination of claim 1, wherein said fixed support comprises a sign and said edge portion is a horizontal edge of the sign.

3. The combination of claim 1, wherein said panel is composed of a rigid plastic material and has a plurality of longitudinal passages disposed parallel to the axis of said tubular member.

4. The combination of claim 3, wherein each panel has an inner section and an outer section, said inner section being connected to said tubular member and said outer section being disposed at an angle to said inner section at a bend.

5. The combination of claim 4, and including a deformable member embedded in each panel and intersecting the passages therein, said deformable member extending across said bend and acting to maintain the outer section in a bent configuration.

6. The combination of claim 5, wherein said deformable member comprises a wire disposed generally normal to said passages and to said bend.

7. The combination of claim 1, wherein the bent section of said element is in helical configuration having a plurality of convolutions, the edge portion of said fixed support being clamped between said convolutions.

* * * * *